US005785190A

United States Patent [19]

Otema

[11] Patent Number: 5,785,190

[45] Date of Patent: Jul. 28, 1998

[54] HARDWARE MOUNTING SYSTEM

[76] Inventor: Martin Otema, 15 Pine Ridge Drive, Scarborough, Ontario, Canada, M1M 2X4

[21] Appl. No.: 819,836

[22] Filed: Mar. 18, 1997

[30] Foreign Application Priority Data

Apr. 12, 1996 [CA] Canada ..... 2174023

[51] Int. Cl.[6] ..... A47F 5/00

[52] U.S. Cl. ..... 211/189; 211/87.01; 211/103; 248/221.12; 248/222.41

[58] Field of Search ..... 211/87.01, 103, 211/189, 90.01, 105.1; 248/220.22, 221.12, 222.41, 223.31

[56] References Cited

U.S. PATENT DOCUMENTS

| | | | |
|---|---|---|---|
| 3,159,368 | 12/1964 | Ahlbin et al. | 248/222.41 |
| 3,270,995 | 9/1966 | Shears | 248/221.12 |
| 4,786,119 | 11/1988 | Smuda | 248/221.12 X |
| 4,815,612 | 3/1989 | Leo | 211/189 |
| 5,653,348 | 8/1997 | MacDonald | 211/87.01 |

FOREIGN PATENT DOCUMENTS

| | | | |
|---|---|---|---|
| 53937 | 11/1937 | Denmark | 248/221.12 |

*Primary Examiner*—Robert W. Gibson, Jr.

[57] ABSTRACT

The invention provides a hardware mounting system for display and shelving units utilizing removable mounting studs which engage through the display panels into slots provided in the hardware. The studs are positioned at any desired location on the panels of the display or shelving unit, and concealed by the hardware when mounted while providing secure engagement of the hardware to the panel. In the preferred embodiment, the stud is inserted through the rear of the panel and projects slightly beyond the front face of the panel when fully inserted so the hardware does not contact the panel. The invention can also be used for affixing abutting sections of the display unit. Thus, the invention allows for the versatile positioning of hardware without detracting from the aesthetic appeal or sacrificing the load bearing capability of the unit.

20 Claims, 3 Drawing Sheets

HARDWARE MOUNTING SYSTEM

FIELD OF INVENTION

This invention relates to display and shelving units. In particular, this invention relates to a hardware mounting system for display and shelving units, for selectively positioning hardware such as brackets, hooks, hangars and the like for supporting or suspending articles, and structures for supporting articles such as shelves, platforms, etc., and for readily interchanging hardware within and between such units.

BACKGROUND OF THE INVENTION

For storing and displaying articles in shelving and display units and the like used in such applications as merchandising, home furnishing and storage, it is advantageous to provide hardware and associated supporting structures which can be positioned in a wide variety of configurations and interchanged with hardware of other types with relative ease. Depending upon the nature of the articles to be stored or displayed, such units may utilize many different types of hardware affixed to a supporting wall or pedestal, such as shelf brackets, hooks, hangars, platforms and other hardware of varying configurations.

A common system used for affixing hardware to these types of units is the slotted standard, which is essentially a metal channel with a main face having a column of vertical slots. Various shapes and styles of brackets are designed with one or more barbed or hooked flanges spaced to fit into the slots in the standard.

While the slotted standard provides some degree of versatility in the height at which the hardware can be mounted, it is conspicuous and quite unattractive. Decorative display and shelving units are often designed primarily for aesthetic appeal, and these standards often significantly detract from their visual appeal. The slotted standard can be recessed into the supporting surface, but the slotted face of the standard inevitably remains largely visible.

SUMMARY OF THE INVENTION

This invention overcomes these disadvantages by providing a hardware mounting system for display and shelving units utilizing removable mounting studs which engage through the panel of the unit into slots provided in the hardware. The studs are inserted at any position desired for the hardware, and are completely concealed by the hardware when mounted while providing secure engagement of the hardware to the panel. Thus, the invention allows for the versatile positioning of hardware, including shelving, platforms and other support means, without detracting from the aesthetic appeal of the unit or sacrificing the load bearing capability of the hardware.

In the preferred embodiment, the stud is inserted through the rear of the panel, either through pre-drilled holes or through holes drilled at selected positions, and projects slightly beyond the front face of the panel when fully inserted. The hardware thus does not contact the panel, and can later be removed or interchanged with hardware of other types without concern for scratches, dents or marring that tends to remain after hardware is removed from a panel. The invention can also be used for mounting abutting panels to one another.

The invention thus provides a hardware mounting system for use in a display or shelving unit having at least one panel with spaced apart holes, comprising a plurality of studs for insertion through the holes, each stud having a securing flange for abutting a rear face of the panel, a post projecting from the securing flange for extending through the holes in the panel, a neck projecting from the post for engaging a slot in a piece of hardware, and an enlarged head projecting from the neck for retaining the hardware on the stud, and at least one piece of hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position on the panel by the heads of the studs.

The invention further provides a display unit comprising at least one panel, a plurality of studs for insertion through holes in the panel, each stud having a securing flange for abutting a rear face of the panel, a post projecting from the securing flange for extending through the holes in the panel, a neck projecting from the post for engaging a slot in a piece of hardware, and an enlarged head projecting from the neck for retaining the hardware on the stud, and at least one piece of hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position on the panel by the heads of the studs.

The invention further provides a hardware mounting system for a display or shelving unit comprising, in combination, at least one panel, a plurality of studs for mounting through holes in the panel, and at least one piece of hardware, each stud having a securing flange for abutting a rear face of the panel, a post projecting from the securing flange for extending through the holes in the panel, a neck projecting from the post for engaging a slot in a piece of hardware, and an enlarged head projecting from the neck for retaining the hardware on the stud, and the hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position on the panel by the heads of the studs.

BRIEF DESCRIPTION OF THE DRAWINGS

In drawings which illustrate a preferred embodiment of the invention by way of example only.

DETAILED DESCRIPTION OF THE INVENTION

Figure 1:
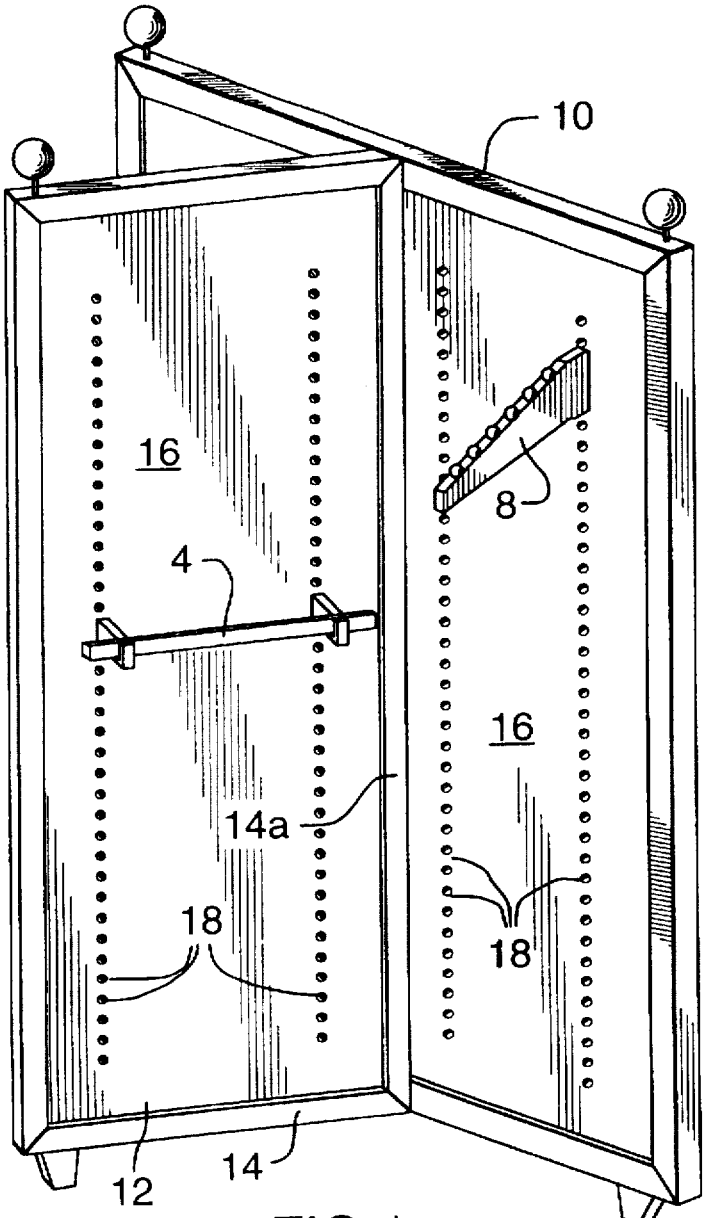
FIG. 1 is a perspective view of a display unit embodying the hardware mounting system of the invention.

FIG. 1 illustrates a display unit embodying a preferred embodiment of the hardware mounting system according to the invention. The display unit illustrated comprises a main section 10 and an abutting section 12, each comprising a frame 14 and a panel 16 having a plurality of holes 18. The frame 14 of the abutting section 12 has an abutting edge 14*a* for attachment to the panel 16 of the main section 10. It will be appreciated that the particular display illustrated is merely one example of many possible displays, and the invention is not intended to be limited by the number, orientations or configurations of display panels.

Figure 3:
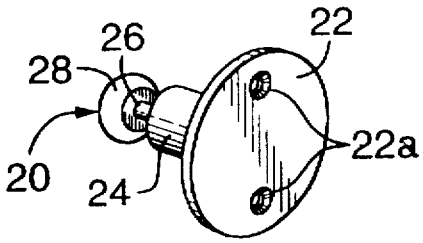
FIG. 3 is a rear perspective view of the stud.
Figure 4:
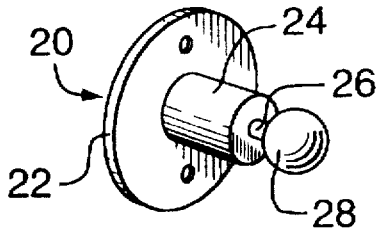
FIG. 4 is a front perspective view of the stud.
Figure 8:
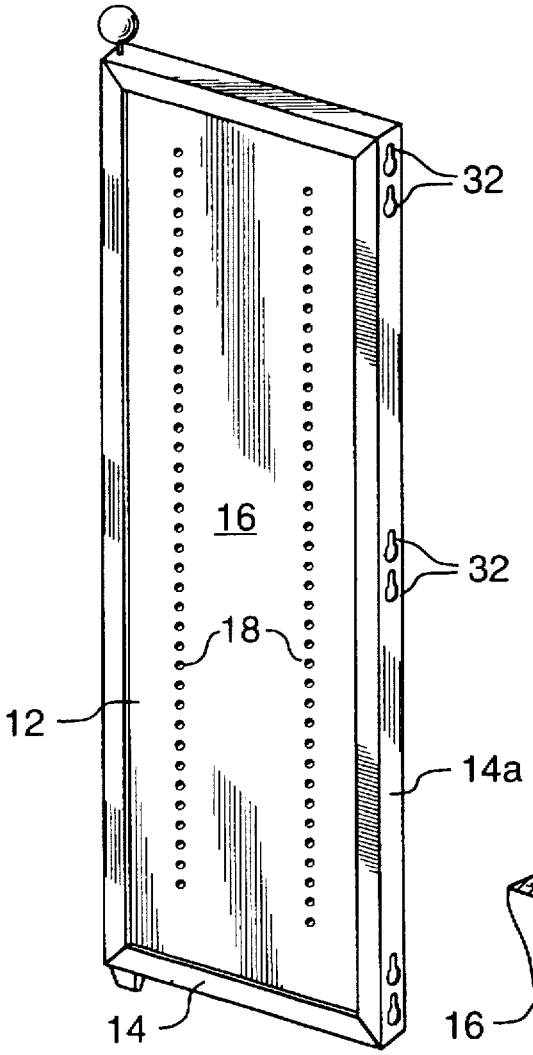
FIG. 8 is a rear perspective view of the abutting section shown in FIG. 1.
Figure 9:
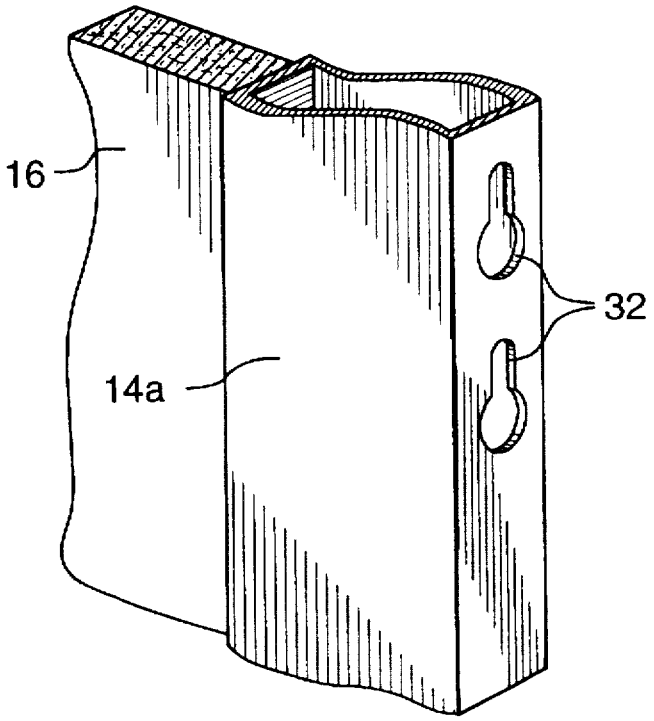
FIG. 9 is an enlarged rear perspective view of the abutting section shown in FIG. 8.

The system of the invention includes a plurality of studs 20, illustrated in FIGS. 3 and 4, which can be removably mounted through the holes 18, and a pair of complimentary slots 30 formed in the rear face of hardware such as a rail 4, shelf bracket 6, hangar bar 8 or the like, or in the abutting edge of a display section such as the abutting edge 14*a*, as shown in FIGS. 8 and 9. It will be appreciated that there are myriad configurations and functions of hardware available for such display units, some being illustrated herein for purposes of example, and the invention is not intended to be limited to any particular type of hardware.

Figure 2:
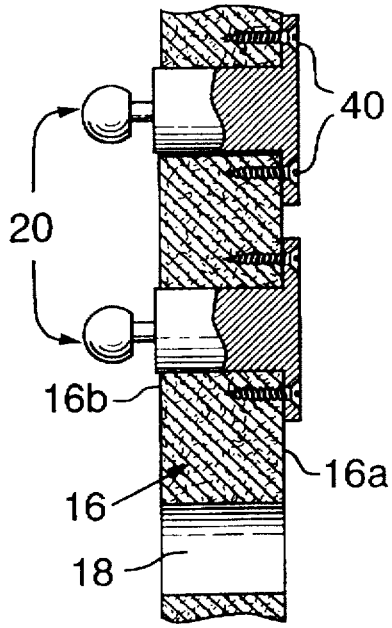
FIG. 2 is a cross section of a panel showing the studs mounted in openings through the panel.

In a preferred embodiment of the invention the stud 20 comprises a securing flange 22 having a cylindrical post 24 projecting centrally therefrom. The post 24 in turn terminates at means for engaging a slot, comprising a constriction or neck 26 which terminates at an enlarged, generally spherical head 28. As best seen in FIG. 2 the head 28 is slightly smaller in diameter than the post 22, for reasons which will be described below. The stud 20 is preferably composed of a strong plastic, metal or another suitable material.

Figure 5:
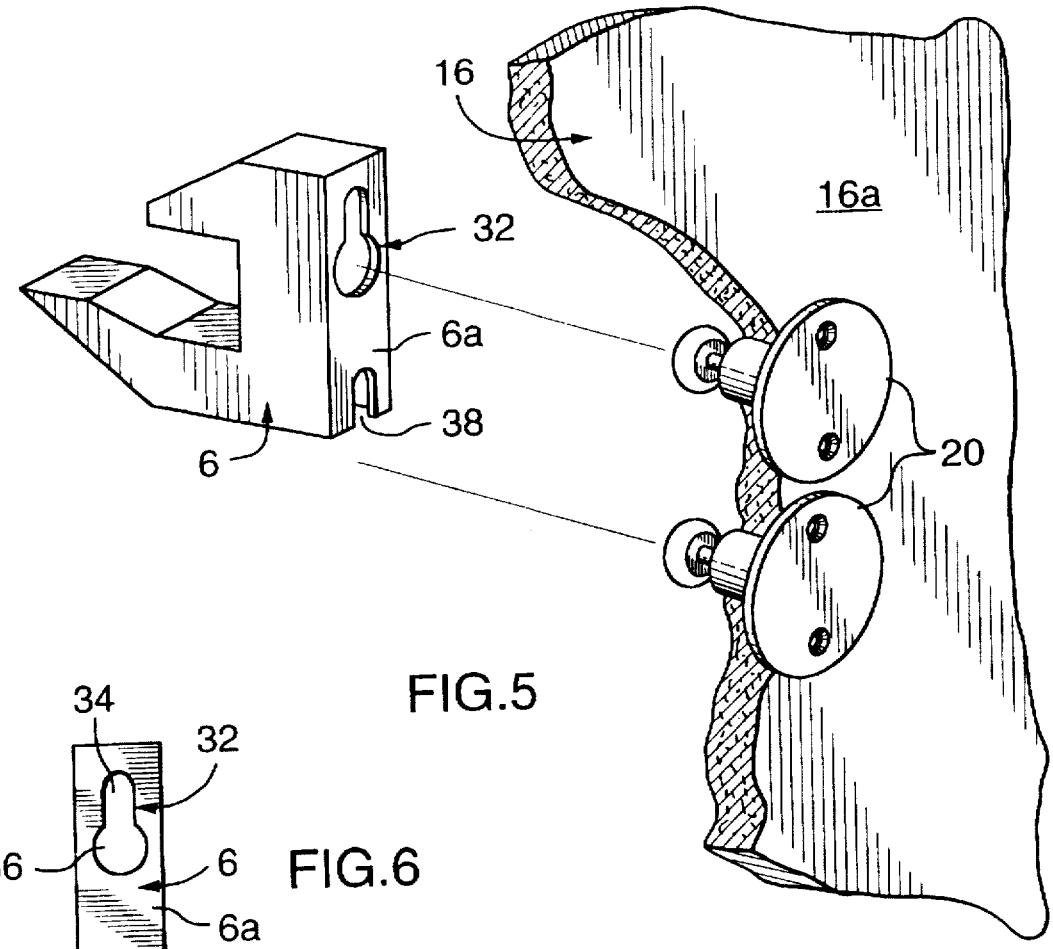
FIG. 5 is a partially cutaway perspective view of a display unit showing the manner of mounting the hardware.
Figure 6:
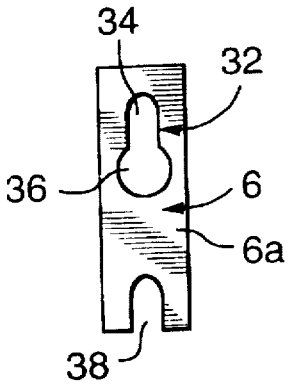
FIG. 6 is a rear view of the hardware.

FIGS. 1 and 5 illustrate examples of typical hardware that might be used in a display, being a rail 4, a shelf clip 6, a hanger bar 8, etc. (as used in this description the term "hardware" includes any supporting or suspending structure that might be used in display and shelving units and the like, including those specifically mentioned, and also shelves, platforms, bars etc., and is not limited to the embodiments shown and described). The rear face 4*a*, 6*a* or 8*a* of each piece of hardware is provided with a pair of slots comprising a keyhole slot 32, having a narrower slot portion 36 accessible through an enlarged access opening 34, and a lower slot 38 configured similarly to the narrow slot portion 36 but extending to the bottom of the rear face 4*a*, 6*a* or 8*a*, as seen in FIG. 6 (hereinafter the slots will be described with reference to the rear face 6*a* of the shelf clip 6, however it will be appreciated that the description applies equally to other types of hardware).

In the embodiment illustrated the slots 32, 38 are oriented substantially vertically. With this configuration the weight of hardware and articles supported thereby helps to prevent upward movement, and thus inadvertent dislodgement of the hardware. It will be appreciated that the slots 32, 38 could be disposed at an inclined angle, so long as the access opening (eg. opening 34) is disposed below the slot, ie. near the lower end of the slot portion 36 or the slot 38. For purposes of maintaining proper vertical alignment of the various pieces of hardware used in the display, the vertical slot orientation is preferred. The slots 32, 38 could also be disposed horizontally, although the risk of inadvertent dislodgement would be somewhat greater.

In the preferred embodiment the lower slot 38 extends fully to the bottom of the rear face 6*a*, such that the access opening for the lower slot 38 is beneath the bottom edge of the rear face 6*a*. Alternatively, the lower slot 38 could be configured as a keyhole slot like the keyhole slot 32, in which case the lower slot 38 would not need to extend to the bottom edge of the rear face 6*a*. Preferably the keyhole slot 32 is located near the top of the rear face 6*a*, to maximize the supporting strength of the mounted hardware, and the enlarged opening 34 is disposed at the bottom of the keyhole slot 32. The hardware includes a hollow portion forwardly of the rear face 6*a*, for accommodating the heads 28 of the studs 20 when the hardware is mounted.

As shown in FIG. 2, the post 24 is slightly longer than the thickness of the panel 16, so that when the securing flange 22 abuts the rear face 16*a* of the panel 16 the post 24 projects slightly beyond the front face 16*b* of the panel 16, for reasons which will be described below. The securing flange 22 is preferably provided with at least two holes 22*a* for screws or other fasteners 40.

Figure 7:
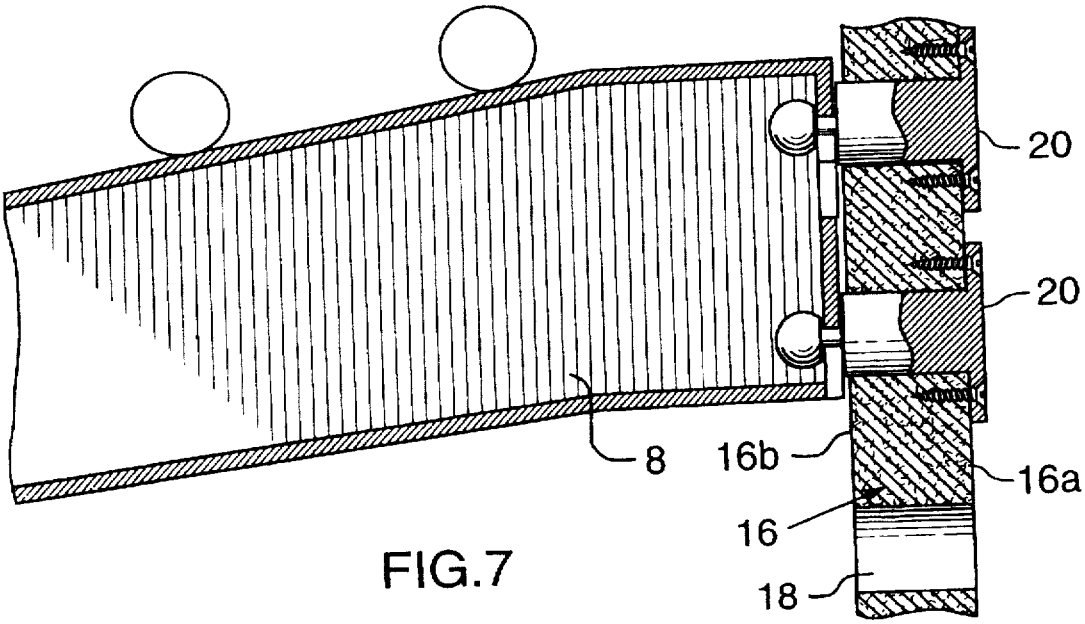
FIG. 7 is a cross section of a panel showing the hardware mounted on the studs.

In use, holes 18 are either pre-drilled or selectively drilled as required through the panel 16 of each section 10, 12 of the display or shelving unit, the holes 18 being dimensioned so that the stud 20 will snugly fit therein. Pairs of holes are spaced vertically such that when the studs 20 are inserted the top of each neck 26 will be spaced apart approximately the same distance as the top of each slot 32, 38 in the hardware, as can be seen in FIG. 7. Two studs 20 are inserted into the rear face 16*a* of the panel 16 and depressed until their securing flanges 22 contact the panel 16. Screws or any other fastening means 40 may be used to secure the studs 20 in place.

The hardware is then mounted on the studs 20. The lower slot 38 is approximately the length of the narrow portion 36 of the upper slot 32 and is open at its bottom edge, so as the head 28 of the upper stud 20 is inserted into the opening 34 of the keyhole slot 32 the open end of the lower slot 38 is positioned immediately above the neck 26 of the lower stud 20, as can be seen in FIG. 5. Because the post 24 has a slightly larger diameter than the opening 34 in the keyhole slot 32, which in turn has a slightly larger diameter than the head 28, the hardware can only be pushed toward the front face 16*b* of the panel 16 until the rear face 6*a* or 8*a* contacts the post 24, which protects the panel 16 from scratching or marring by the hardware.

Once the rear face 6*a* or 8*a* has cleared the heads 28 of the studs 20, the hardware is depressed or tapped down into position, with the top edges of the slots 30 resting on the necks 16, as shown in FIG. 7. Preferably the length of the neck 26 approximates the thickness of the rear wall 6*a* or 8*a* and the head 28 has a flattened rear surface which will abut the rear face 6*a* or 8*a*, as seen in FIG. 7, such that there is a slightly frictional fit between the head 28, the rear wall 6*a* or 8*a* and the post 24 so that the hardware will not wobble when mounted.

FIGS. 8 and 9 illustrate an embodiment of the invention applied to secure the abutting edge 14*a* of the abutting section 12 to the main panel section 10. The slots 32, 38 are provided at suitable locations along the abutting edge 14*a* of the frame 14, and studs 20 are mounted at complimentary positions along the panel 16 of the main section 10. The abutting section 12 is mounted by raising it slightly to align the openings 34 with the heads 28 of the studs 20, forcing it toward the studs 20 and tapping it down into position.

Preferred embodiments of the invention having been described above by way of example, it will be apparent to those skilled in the art that certain modifications and adaptations may be made without departing from the scope of the invention as set out in the appended claims. All such modifications and adaptations are intended to fall within the invention.

I claim:

1. A hardware mounting system for use in a display or shelving unit having at least one panel with spaced apart holes, comprising a plurality of studs for insertion through the holes, each stud having a securing flange for abutting a rear face of the panel, a post projecting from the securing flange for extending through the holes in the panel, the post extending beyond a front face of the panel, a neck projecting from the post for engaging a slot in a piece of hardware, and an enlarged head projecting from the neck for retaining the hardware on the stud, and at least one piece of hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position spaced from the panel by the heads of the studs.

2. The hardware mounting system of claim 1 in which the post of a stud has a larger cross-section than the head of the stud and at least one of the access openings in communication with the slots in the hardware is smaller than the cross-section of the post of the stud, whereby the post prevents the hardware from coming into contact with the panel.

3. The hardware mounting system of claim 1 in which the hardware has an upper slot provided with an access opening larger than the head of a stud and a lower slot extending to a lower edge of the rear face and in communication with an access opening beneath the rear face of the hardware.

4. The hardware mounting system of claim 3 in which the lower slot is disposed in substantially vertical alignment with the upper slot.

5. The hardware mounting system of claim 1 in which the heads of the studs are spaced from the posts a distance approximating the thickness of the rear face of the hardware.

6. The hardware mounting system of claim 5 in which the heads of the studs are provided with a flattened rear surface for abutting the rear face of the hardware.

7. A display unit comprising at least one panel, a plurality of studs for insertion through holes in the panel, each stud having a securing flange for abutting a rear face of the panel, a post projecting from the securing flange for extending through the holes in the panel beyond a front face of the panel, a neck projecting from the post for engaging a slot in a piece of hardware, and an enlarged head projecting from the neck for retaining the hardware on the stud, and at least one piece of hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position spaced from the panel by the heads of the studs.

8. The display unit of claim 7 in which the post of a stud has a larger cross-section than the head of the stud and at least one of the access openings in communication with the slots in the hardware is smaller than the cross-section of the post of the stud, whereby the post prevents the hardware from coming into contact with the panel.

9. The display unit of claim 7 in which the hardware has an upper slot provided with an opening larger than the head of a stud and a lower slot extending to a lower edge of the rear face and in communication with an access opening beneath the rear face of the hardware.

10. The display unit of claim 9 in which the lower slot is disposed in substantially vertical alignment with the upper slot.

11. The display unit of claim 7 in which the heads of the studs are spaced from the posts a distance approximating the thickness of the rear face of the hardware.

12. The display unit of claim 11 in which the heads of the studs are provided with a flattened rear surface for abutting the rear face of the hardware.

13. A hardware mounting system for a display or shelving unit comprising, in combination, at least one panel, a plurality of studs for mounting through holes in the panel, and at least one piece of hardware, each stud having a securing flange for abutting a rear face of the panel, a post projecting from the securing flange for extending through the holes in the panel beyond a front face of the panel, a neck projecting from the post for engaging a slot in a piece of hardware, and an enlarged head projecting from the neck for retaining the hardware on the stud, and the hardware having a rear face provided with at least two slots for engaging over the necks of two adjacent studs, the slots being spaced apart by a spacing substantially the same as the spacing of the holes and each slot being in communication with an access opening below the slot to allow for insertion of the head of a stud, and a hollow portion forwardly of the rear face for accommodating the heads of the studs, wherein the slots are narrower than the heads of the studs and the hardware is thereby retained in a mounted position spaced from the panel by the heads of the studs.

14. The combination of claim 13 in which the post of a stud has a larger cross-section than the head of the stud and at least one of the access openings in communication with the slots in the hardware is smaller than the cross-section of the post of the stud, whereby the post prevents the hardware from coming into contact with the panel.

15. The combination of claim 13 in which the hardware has an upper slot provided with an opening larger than the head of a stud and a lower slot extending to a lower edge of the rear face and in communication with an access opening beneath the rear face of the hardware.

16. The combination of claim 13 which the heads of the studs are spaced from the posts a distance approximating the thickness of the rear face of the hardware.

17. The combination of claim 16 in which the heads of the studs are provided with a flattened rear surface for abutting the rear face of the hardware.

18. A display unit comprising at least one panel, and a plurality of studs for insertion through holes in the panel, each stud having a securing flange abutting the panel, a post projecting from the securing flange for extending through the holes in the panel beyond a front face of the panel, a neck projecting from the post, and an enlarged head projecting from the neck for retaining the hardware on the stud, wherein a piece of hardware having a rear face provided with slots for engaging over the necks of adjacent studs, the slots being narrower than the heads of the studs and being spaced apart by a spacing substantially the same as the spacing of the holes and each slot being in communication with an access opening below the slot to allow for insertion of the head of a stud and having a hollow portion forwardly of the rear face for accommodating the heads of the studs, can be mounted over the studs such that the heads of the studs thereby retain the hardware in a mounted position spaced from the panel.

19. The hardware mounting system of claim 18 in which the heads of the studs are spaced from the posts a distance approximating the thickness of the rear face of the hardware.

20. The hardware mounting system of claim 18 in which the heads of the studs are provided with a flattened rear surface for abutting the rear face of the hardware.

* * * * *